US009907118B2

(12) United States Patent
Ooyama et al.

(10) Patent No.: US 9,907,118 B2
(45) Date of Patent: Feb. 27, 2018

(54) CURRENT APPLYING APPARATUS, CURRENT APPLYING METHOD AND DIRECT RESISTANCE HEATING APPARATUS

(71) Applicant: NETUREN CO., LTD., Shinagawa-ku, Tokyo (JP)

(72) Inventors: Hironori Ooyama, Tokyo (JP); Kunihiro Kobayashi, Tokyo (JP)

(73) Assignee: NETUREN CO., LTD., Tokyo (JP)

( * ) Notice: Subject to any disclaimer, the term of this patent is extended or adjusted under 35 U.S.C. 154(b) by 448 days.

(21) Appl. No.: 14/403,493

(22) PCT Filed: May 31, 2013

(86) PCT No.: PCT/JP2013/065769
§ 371 (c)(1),
(2) Date: Nov. 24, 2014

(87) PCT Pub. No.: WO2013/180313
PCT Pub. Date: Dec. 5, 2013

(65) Prior Publication Data

US 2015/0173126 A1 Jun. 18, 2015

(30) Foreign Application Priority Data

Jun. 1, 2012 (JP) ..... 2012-126593

(51) Int. Cl.
*H05B 3/03* (2006.01)
*C21D 9/46* (2006.01)
(Continued)

(52) U.S. Cl.
CPC ..... *H05B 3/03* (2013.01); *C21D 1/40* (2013.01); *H05B 3/0004* (2013.01); *H05B 3/023* (2013.01);
(Continued)

(58) Field of Classification Search
CPC ..... H05B 3/03; H05B 3/023; H05B 3/0004; C21D 9/0012; C21D 9/0068; C21D 9/46; B23K 11/06; B23K 11/3036
(Continued)

(56) References Cited

U.S. PATENT DOCUMENTS 2,373,314 A * 4/1945 Keller ..... B23K 11/06 219/81
2,453,438 A * 11/1948 Horth ..... B23K 11/3018 219/81
(Continued)

FOREIGN PATENT DOCUMENTS

JP 53-7517 1/1978
JP 61-37922 2/1986
(Continued)

OTHER PUBLICATIONS

International Search Report and Written Opinion for PCT/JP2013/065769, dated Nov. 11, 2013.

*Primary Examiner* — Arthur O Hall
*Assistant Examiner* — Joseph A Greenlund
(74) *Attorney, Agent, or Firm* — Wenderoth, Lind & Ponack, L.L.P.

(57) ABSTRACT

A current applying apparatus includes a pair of electrodes configured to contact a workpiece to apply an electric current to the workpiece, and a bus bar arranged to extend along the workpiece. At least one of the electrodes includes a moving electrode configured to move relative to the bus bar and the workpiece such that an electric current flows between the bus bar and the workpiece through the moving electrode, the moving electrode being connected to the bus bar so as to be movable relative to the bus bar, and the moving electrode being configured to contact the workpiece so as to be movable relative to the workpiece.

13 Claims, 7 Drawing Sheets

(51) Int. Cl.

| | |
|---|---|
| ***B23K 11/06*** | (2006.01) |
| ***C21D 1/40*** | (2006.01) |
| ***H05B 3/00*** | (2006.01) |
| ***H05B 3/02*** | (2006.01) |
| *C21D 9/00* | (2006.01) |

(52) U.S. Cl.
CPC ..... *C21D 9/0012* (2013.01); *C21D 9/0068* (2013.01); *C21D 9/46* (2013.01)

(58) Field of Classification Search
USPC ..... 219/50, 81, 82, 88
See application file for complete search history.

(56) References Cited

U.S. PATENT DOCUMENTS 2,684,424 A * 7/1954 Anderson ..... B23K 11/06 188/74
3,504,155 A * 3/1970 Byland ..... B23K 11/309 219/81
3,564,189 A * 2/1971 Rhodes ..... B23K 11/061 219/61.12
3,909,578 A * 9/1975 Williams ..... B23K 11/061 219/82
3,909,579 A * 9/1975 Williams ..... B23K 11/061 219/83
4,079,223 A * 3/1978 Lee ..... B23K 11/30 219/118
4,315,125 A * 2/1982 Schmidt ..... B23K 11/008 140/112
4,333,777 A * 6/1982 Takeuchi ..... C21D 1/34 266/87
4,536,636 A * 8/1985 Opprecht ..... B23K 11/063 219/81
4,572,937 A * 2/1986 Opprecht ..... B23K 11/06 219/81
4,642,436 A * 2/1987 Rethwish ..... B23K 11/0093 219/78.11
5,313,041 A * 5/1994 Levy ..... B23K 11/258 219/109
5,676,862 A * 10/1997 Matteson ..... B23K 11/063 219/110
5,883,353 A * 3/1999 Yoshida ..... B23K 11/061 219/81
6,268,581 B1 * 7/2001 Nakamura ..... B23K 11/06 219/81
6,281,467 B1 * 8/2001 Gould ..... B23K 11/063 219/118
6,448,532 B1 * 9/2002 Mittler ..... B23K 11/11 219/117.1
6,479,784 B1 * 11/2002 Tagliavini ..... B23K 11/061 219/109
6,512,195 B2 * 1/2003 Domschot ..... B23K 11/115 219/158
6,572,003 B2 * 6/2003 Miyata ..... B23K 11/0073 219/101
7,838,791 B2 * 11/2010 Nagashima ..... B29B 17/02 219/69.11
2002/0011466 A1 * 1/2002 Muller ..... B23K 11/063 219/64
2003/0217991 A1 * 11/2003 Gomez ..... C21D 1/40 219/50
2008/0227361 A1 * 9/2008 Kuebler ..... H05B 33/10 445/46
2008/0237197 A1 * 10/2008 Saito ..... B23K 11/061 219/78.01
2010/0269559 A1 * 10/2010 Ishiguro ..... C21D 1/673 72/342.1
2012/0074103 A1 * 3/2012 Hasegawa ..... B23K 11/061 219/102
2014/0061168 A1 * 3/2014 Nakakura ..... B23K 11/063 219/82
2014/0339210 A1 * 11/2014 Kobayashi ..... C21D 1/40 219/162
2015/0173125 A1 * 6/2015 Ooyama ..... C21D 9/0068 219/162
2015/0173126 A1 * 6/2015 Ooyama ..... C21D 1/40 219/50
2015/0208466 A1 * 7/2015 Ooyama ..... C21D 9/0012 219/162
2015/0298244 A1 * 10/2015 Nakakura ..... B23K 11/065 219/82

FOREIGN PATENT DOCUMENTS

JP 61037922 A * 2/1986 ..... C21D 1/34
JP 06-079389 3/1994
JP 07-122350 5/1995
JP 3587501 8/2004
WO 2013-081180 6/2013

* cited by examiner

CURRENT APPLYING APPARATUS, CURRENT APPLYING METHOD AND DIRECT RESISTANCE HEATING APPARATUS

TECHNICAL FIELD

The present invention relates to a current applying apparatus, a current applying method and a direct resistance heating apparatus, which are for directly applying an electric current to a workpiece such as a steel blank.

BACKGROUND ART

Heat treatment is applied to, for example, vehicle structures such as a center pillar and a reinforcement to ensure strength. Heat treatment can be classified into two types, namely, indirect heating and direct heating. An example of indirect heating is a furnace heating in which a workpiece is placed inside a furnace and the temperature of the furnace is controlled to heat the workpiece. Examples of direct heating include induction heating in which an eddy current is applied to a workpiece to heat the workpiece, and a direct resistance heating (also called as a direct electric conduction heating) in which an electric current is applied directly to a workpiece to heat the workpiece.

According to a first related art, a metal blank is heated by induction heating or electric conduction heating prior to being subjected to plastic working by working means. For example, the heating means having electrode rollers or an induction coil is disposed upstream of the working means having a cutter machine, and the metal blank is heated while continuously being conveyed (see, e.g., JP06-079389A).

According to a second related art, to heat a steel plate having a varying width along the longitudinal direction of the steel plate, a set of multiple electrodes are disposed side by side on one side of the steel plate in the widthwise direction, and another set of multiple electrodes are disposed side by side on the other side of the steel plate in the widthwise direction, such that the electrodes disposed on respective sides of the steel plate in the widthwise direction form multiple pairs of electrodes. In this case, an equal electric current is applied between each of the pair of electrodes, so that the steel plate is heated to a uniform temperature (see, e.g., JP3587501B2).

When heating a workpiece, in particular, a workpiece having a varying width along the longitudinal direction of the workpiece, it is preferable that an amount of heat applied per unit volume is the same over the entire workpiece, like in the furnace heating. However, a heating furnace requires large-scale equipment, and a temperature control of the furnace is difficult. Accordingly, in terms of production cost, a direct resistance heating like those of the first related art and the second related art is preferable.

However, to heat a workpiece such as a steel blank having small resistance by direct resistance heating, large current needs to be applied to the workpiece. In this case, it is not easy to apply a desired current to the workpiece. Further, when a plurality of pairs of electrodes is provided like in the second related art, an amount of electric current to be applied is controlled for each of the pairs of electrodes, which makes the apparatus complicated and large-scale.

SUMMARY OF INVENTION

It is an object of the present invention to provide a current applying apparatus, a current applying method and a direct resistance heating apparatus having the current applying apparatus, which can easily apply, with a simple configuration, a large current to a current-applying region of a workpiece and can change the current-applying region or a current-applying time.

According to an aspect of the present invention, a current applying apparatus includes a pair of electrodes configured to contact a workpiece to apply an electric current to the workpiece, and a bus bar arranged to extend along the workpiece. At least one of the electrodes includes a moving electrode configured to move relative to the bus bar and the workpiece such that an electric current flows between the bus bar and the workpiece through the moving electrode, the moving electrode being connected to the bus bar so as to be movable relative to the bus bar, and the moving electrode being configured to contact the workpiece so as to be movable relative to the workpiece.

The moving electrode may be arranged between the bus bar and the workpiece. The moving electrode may include a current-applying roller configured to roll on a surface of the workpiece. The current-applying roller may include an electrically-conductive peripheral surface from which the electric current is applied to the surface of the workpiece. The current applying may further include a pressing member arranged to face the moving electrode and to move together with the moving electrode. The pressing member may be configured to press the workpiece against the moving electrode.

The current applying may further include a power feeding roller configured to contact and roll on a surface of the bus bar and to move together with the moving electrode. The power feeding roller may include an electrically-conductive peripheral surface from which the electric current is supplied to the moving electrode.

The current-applying roller and the power feeding roller may be arranged to rotate in opposite directions and to contact each other. An axis of the power feeding roller may be arranged at a position shifted from a plane including a portion of the current-applying roller contacting the workpiece and an axis of the current-applying roller.

The current applying apparatus may further include an electrically-conductive brush provided on a surface of the bus bar facing toward the workpiece. The moving electrode may be arranged to move in sliding contact with the electrically-conductive brush. The electrically-conductive brush may be arranged to face substantially an entire region of the workpiece where the electric current is to be applied.

The power feeding roller may be provided on both axial end portions of the moving electrode to supply the electric current from the power feeding roller to the moving electrode.

According to another aspect of the present invention, a current applying method is provided for applying an electric current to a workpiece by contacting a pair of electrodes to the workpiece. The current applying method includes providing a bus bar to extend along the workpiece and to face the workpiece, and moving at least one of the electrodes relative to the bus bar and the workpiece such that an electric current flows between the bus bar and the workpiece through the at least one of the electrodes, with the at least one of the electrodes being connected to the bus bar and contacting the workpiece.

According to another aspect of the present invention, a direct resistance heating apparatus includes the current applying apparatus described above and a power supply configured to supply the electric current to the current applying apparatus.

According to the present invention, because the bus bar is arranged along the workpiece, a loop is not formed by the bus bar so that it is possible to reduce inductance component. As a result, the power factor is not degraded and therefore it is possible to apply a predetermined current to the workpiece.

The moving electrode is movable relative to the bus bar and the workpiece in an electrically contacting manner such that an electric current flows between the bus bar and the workpiece through the moving electrode. Therefore, it is possible to change the region of the workpiece to which a large current is supplied or to change the current-applying time.

The relative position between the workpiece and the bus bar is not changed and the constant of circuit configured by including the workpiece as a load is not changed. Accordingly, it is possible to supply a predetermined current by a simple configuration.

Further, the current-applying region or the current-applying time can be changed just by moving the moving electrode. Therefore, it is not necessary to provide a number of electrodes or power feeding structures or to provide a structure for moving the workpiece or the bus bar. Accordingly, it is possible to provide the current applying apparatus in a simple and compact manner.

As a result, it is possible to provide a current applying apparatus, a current applying method and a direct resistance heating apparatus, in which a predetermined large current can be easily and simply supplied to the current-applying region of the workpiece by changing the current-applying region or the current-applying time.

DESCRIPTION OF EMBODIMENTS

Figure 1A:
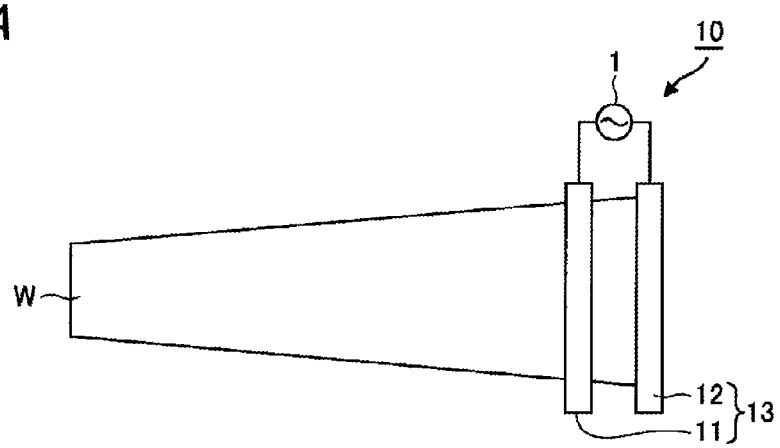
FIG. 1A is a plan view of a direct resistance heating apparatus according to one or more embodiments of the present invention, illustrating a state before applying an electric current.
Figure 1B:
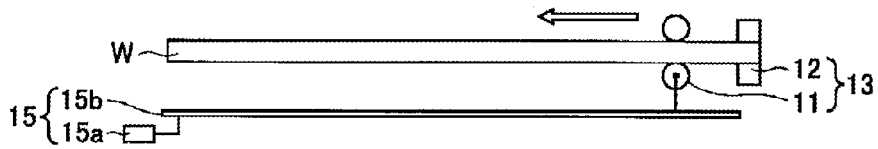
FIG. 1B is a front view of the direct resistance heating apparatus, illustrating a state before applying the electric current.

Hereinafter, embodiments of the present invention will be described in detail with reference to the drawings. In the following embodiments, as an example, a direct resistance heating apparatus for heating a workpiece by directly feeding an electric current to the workpiece will be described.

A workpiece to which an electric current is applied according to one or more embodiments of the present invention is electrically conductive, and preferably has a flat surface or a curved surface on which an electrode is movable in a state in which the electrode is contacting the surface. For example, a plate material having a flat surface is suitable. The workpiece may be entirely made of the same material, or may be made by joining the materials having different resistivity by welding or the like.

The workpiece has a current-applying region (hereinafter, "heating target region") to be heated by applying an electric current. For example, a steel blank may be a workpiece having a heating target region. The workpiece may include one heating target region or a plurality of heating target regions. When the workpiece includes a plurality of heating target regions, the heating target regions may be contiguous to each other or may be spaced apart from each other.

A workpiece to which an electric current is applied according to one or more embodiments of the present invention may have a constant thickness and constant width along a longitudinal direction of the workpiece. Alternatively, the workpiece may have, in a heating target region, a varying thickness or a varying width along the longitudinal direction of the workpiece so that a sectional area is reduced along the longitudinal direction of the workpiece. The workpiece may be formed with an opening or a cut-out region. A cross section of the workpiece taken along a plane perpendicular to the longitudinal direction of the workpiece may be reduced along the longitudinal direction of the workpiece.

FIGS. 1A to 1D illustrate a direct resistance heating apparatus 10 according to one or more embodiment of the present invention.

The direct resistance heating apparatus 10 includes a pair of electrodes 13 having one electrode 11 electrically connected to a power supply unit 1 and the other electrode 12, and a moving mechanism 15 configured to move one electrode 11 or the other electrode 12.

In the example shown in FIGS. 1A to 1D, one electrode 11 is moved by the moving mechanism 15 and therefore referred to as a moving electrode and the other electrode 12 is held in a predetermined position of a workpiece W and therefore referred to as a fixed electrode. Alternatively, the other electrode 12 may be a moving electrode and one electrode 11 may be a fixed electrode, or both one electrode 11 and the other electrode 12 may be a moving electrode.

The moving mechanism 15 includes a structure which supports one electrode 11 or the other electrode 12 so as to be movable along the workpiece W and can control the moving speed and the moving amount of the moving electrode. For example, the moving mechanism 15 is configured in such a way that one electrode 11 or the other electrode 12 is mounted on a slide rail, is screwed to a drive transmission unit 15*b* (such as ball screws which are juxtaposed) for transmitting a driving force and is driven by an adjustment unit 15*a* (such as a step motor) which can adjust the moving speed.

Figure 1C:
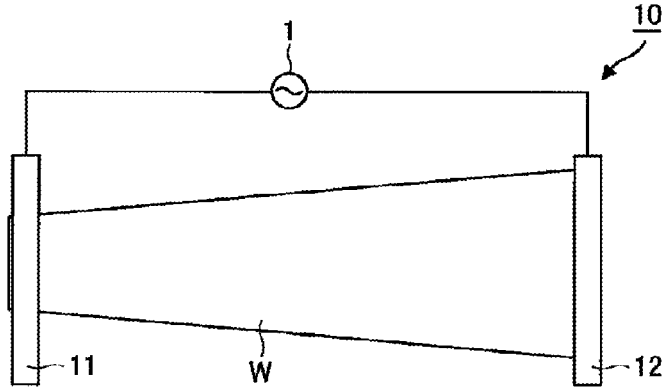
FIG. 1C is a plan view of the direct resistance heating apparatus, illustrating in a state after applying the electric current.
Figure 1D:
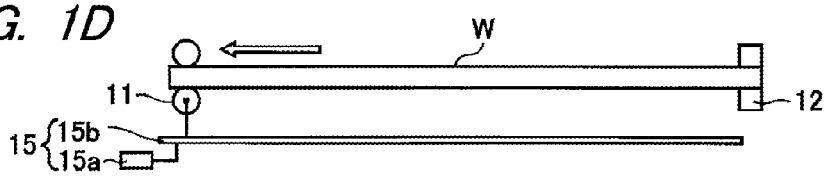
FIG. 1D is a front view of the direct resistance heating apparatus, illustrating in a state after applying the electric current.

In the example shown in FIGS. 1A to 1D, the entire region of the workpiece W is the heating target region and a width of the workpiece is gradually narrowed along the moving direction of the electrode. For this reason, from a position where one electrode 11 and the other electrode 12 are adjacent to each other as shown in FIG. 1A, one electrode 11 is moved to one side and the moving amount or moving speed of one electrode 11 is adjusted while constant current is supplied from the power supply unit 1 to the workpiece W via the pair of electrodes 13, as shown in FIG. 1C. By doing so, heat treatment is performed in such a way that the current-applying time of each heating target region is varied and therefore the amount of heat is controlled. In this way, the entire heating target region can be heated.

Hereinafter, a specific example of the direct resistance heating apparatus will be described.

First Embodiment

Figure 2:
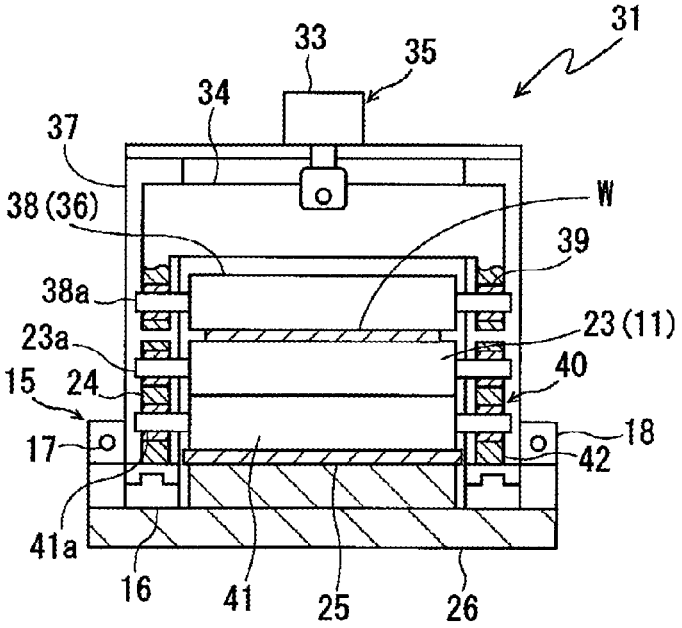
FIG. 2 is a sectional view showing a current applying apparatus mounted on a heating apparatus in a first embodiment.
Figure 3:
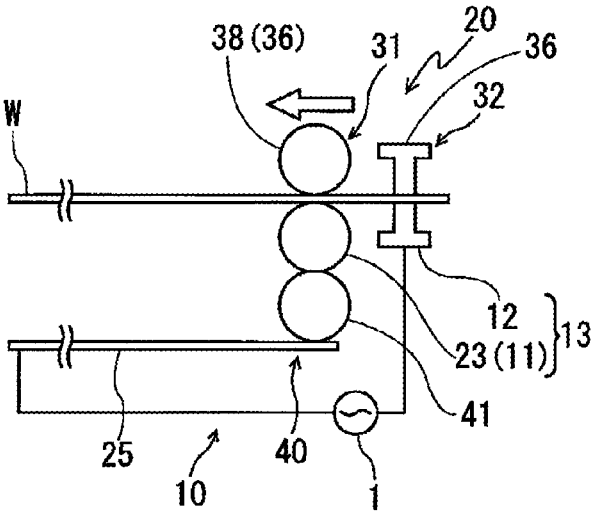
FIG. 3 is a side view schematically showing a structure of the current applying apparatus mounted on the heating apparatus in the first embodiment.

As shown in FIG. 2 and FIG. 3, the direct resistance heating apparatus 10 of the first embodiment includes the power supply unit 1 for feeding a predetermined alternating current to the workpiece W and a current applying apparatus 20 connected to the power supply unit 1. The current applying apparatus 20 includes a bus bar 25, a moving unit 31 having the moving electrode 11 and a fixed unit 32 having the fixed electrode 12. The current applying apparatus 20 is provided with a workpiece support portion which supports the workpiece W in a predetermined position (not shown). The current applying apparatus 20 is configured so that a surface of the bus bar 25 is arranged substantially parallel along a surface of the workpiece W when the workpiece W is supported on the workpiece support portion.

The power supply unit 1 can apply a predetermined current to the workpiece W during direct resistance heating. The power supply unit may be provided integrally with the current applying apparatus or separately from the current applying apparatus. Herein, the power supply unit is adapted to supply a substantially constant average current during direct resistance heating.

The bus bar 25 is, for example, a rigid plate member made of highly electrically-conductive material such as copper, and has a cross-sectional area that is sufficient to feed the electric current required for the direct resistance heating. The bus bar 25 is fixed to a mounting base 26 so as to extend along the heating target region of the workpiece W. The bus bar 25 is connected to one of the electrodes of the power supply unit 1. In this embodiment, the bus bar 25 has a surface that faces the workpiece W. More specifically, the bus bar 25 has a flat and smooth surface that faces the entire heating target region of the workpiece W other than a portion of the workpiece W on which the fixed electrode 12 is provided. That is, in a direction perpendicular to the moving direction of the moving electrode 11, the bus bar 25 extends along the entire length of a portion of the moving electrode 11 that is configured to contact the workpiece W.

The moving unit 31 includes the moving electrode 11 disposed so as to contact with the heating target region of the workpiece W, a power feeding mechanism 40 for feeding power to the moving electrode 11 from the bus bar 25, a pressing member 36 disposed opposite to the moving electrode 11, a press mechanism 35 for driving the pressing member 36, and the moving mechanism 15 for moving a movement frame 37 on which these parts are integrally supported along the workpiece W.

Herein, the moving electrode 11 and the power feeding mechanism 40 can be moved integrally with the movement frame 37 by the moving mechanism 15 while being disposed between the bus bar 25 and the workpiece W.

The moving electrode 11 is configured by a current-applying roller 23 which rolls in contact with a surface of the workpiece W. Entire peripheral surface of the current-applying roller 23 is made of a conductive material. The current-applying roller 23 is rotatably supported on a bearing portion 24 which is fixed to the movement frame 37 in a state where a shaft portion 23*a* of the current-applying roller is insulated from a peripheral surface thereof. The peripheral surface of the current-applying roller 23 is formed of highly electrically-conductive material such as copper, cast iron and carbon and is configured as a smooth surface having a circular section. The peripheral surface of the current-applying roller 23 is electrically connected to the bus bar 25 via the power feeding mechanism 40. The peripheral surface of the current-applying roller 23 contacts the heating target region of the workpiece W in a direction perpendicular to a moving direction of the current-applying roller 23, and the portion of the current-applying roller 23 contacting the heating target region of the workpiece W extends across the entire width of the heating target region.

The power feeding mechanism 40 includes a power feeding roller 41 configured to contact and roll on the surface of the bus bar 25. Entire peripheral surface of the power feeding roller 41 is made of a conductive material. The power feeding roller 41 is rotatably supported on a bearing portion 42 which is fixed to the movement frame 37 in a state where a shaft portion 41*a* of the power feeding roller is insulated from a peripheral surface thereof. The peripheral surface of the power feeding roller 41 is formed of high conductive material such as copper, cast iron and carbon and configured as a smooth surface having a circular section. The peripheral surface of the power feeding roller 41 contacts the surface of the bus bar 25 that faces toward the workpiece W in a direction perpendicular to the moving direction of the power feeding roller 41. The portion of the power feeding roller 41 contacting the surface of the bus bar 25 extends substantially across the entire width of the bus bar 25.

Although other rollers or the like may be interposed between the power feeding roller 41 and the current-applying roller 23, the current-applying roller 23 is in direct contact with the power feeding roller 41 over a substantially entire axial length in the present embodiment. Herein, since the current-applying roller 23 and the power feeding roller 41 are rotated in opposite directions, the current-applying roller and the power feeding roller are always in contact without sliding. During direct resistance heating, a large current can be supplied to the current-applying roller 23 from the bus bar 25 via the peripheral surface of the power feeding roller 41.

The pressing member 36 is configured by a holding roller 38 which is disposed at a position facing the current-applying roller 23 through the workpiece W. Although material of the holding roller 38 is not particularly limited as long as the holding roller can come into contact the workpiece W to pressurize the workpiece, it is preferable that the holding roller is made of material having a thermal conductivity lower than the current-applying roller 23. For example, the holding roller may be formed of cast iron, ceramics, etc.

A shaft portion 38*a* of the holding roller is rotatably supported on a bearing portion 39 which is movably supported on the movement frame 37. In the present embodiment, the bearing portion 39 is supported on a movable bracket 34 provided in the press mechanism 35 and therefore is movable in a contact/separation direction with respect to the current-applying roller 23.

Further, the holding roller 38 is supported on the movement frame 37 and therefore can be moved together with the current-applying roller 23 and the power feeding roller 41.

The press mechanism 35 includes a pressurizing cylinder 33 mounted on the movement frame 37 of the moving mechanism 15 and a movable bracket 34 which is connected to the pressurizing cylinder 33 to be movable. Herein, the movable bracket 34 is pressed against the current-applying roller 23 by being pressurized by the pressurizing cylinder 33 and the holding roller 38 presses the workpiece W toward the current-applying roller 23.

The moving mechanism 15 includes a slide rail 16 disposed in a uniaxial direction on the mounting base 26, the movement frame 37 supported on the slide rail 16, a threaded shaft 17 which is disposed along the slide rail 16 on the mounting base 26 and rotationally driven by a step motor or the like, and a driving support portion 18 which is attached to the movement frame 37 and to which the threaded shaft 17 is screwed. Respective bearing portions of the current-applying roller 23, the power feeding roller 41 and the holding roller 38 are supported on the movement frame 37. In the moving mechanism 15, when the threaded shaft 17 is driven while the rotation speed or the rotation amount thereof is controlled, the movement frame can be moved in a predetermined speed and a predetermined amount along the slide rail 16.

The fixed unit 32 includes the fixed electrode 12 disposed so as to contact with an end portion of the heating target region of the workpiece W, the pressing member 36 disposed opposite to the fixed electrode 12 and a press mechanism for driving the pressing member 36. The fixed electrode 12 is connected to the other electrode of the power supply unit 1. The press mechanism is configured similarly to the press mechanism 35 of the moving unit 31.

The fixed electrode 12 is disposed so as to contact across the entire width of the heating target region in one end of the heating target region of the workpiece W. The fixed electrode 12 is formed of high conductive material such as copper, cast iron, carbon, etc. and a contact surface thereof with the workpiece W is configured as a smooth surface. The fixed electrode 12 can reduce the heat transfer from the workpiece W by reducing the contact area with the workpiece W. Further, in order to prevent temperature decrease in the vicinity of the fixed electrode 12 during direct resistance heating, a heater for heating the fixed electrode 12 may be housed therein.

Direct Resistance Heating Method

A method for heating the workpiece W by supplying current to the workpiece W using the above-described direct resistance heating apparatus 10 will be described.

First, a plate-like workpiece W is placed at a predetermined position in a substantially horizontal state by the workpiece support portion. Thereby, a surface of the bus bar 25 is disposed adjacent to and along the entire heating target region of the workpiece W, so that the surface of the bus bar 25 and a surface of the workpiece W are opposed to each other in a substantially parallel manner.

In the fixed unit 32, the end portion of the heating target region of the workpiece W is brought into contact, over the substantially entire width thereof, with the surface of the fixed electrode 12 and the workpiece W is pressed against the fixed electrode 12 by the pressing member 36. Further, in the fixed unit 32, the end portion of the heating target region of the workpiece W is brought into contact, in the vicinity thereof, with the surface of the current-applying roller 23 and the workpiece W is pressed against the current-applying roller 23 by the holding roller 38.

In this state, voltage is applied to the fixed electrode 12 and the bus bar 25 from the power supply unit 1. Thereby, power is supplied from the bus bar 25 to the current-applying roller 23 through the power feeding roller 41 and current is supplied to a heating target region between the current-applying roller 23 and the fixed electrode 12.

Thereafter, the movement frame 37 is moved in a direction away from the fixed unit 32 by the moving mechanism. Then, the current-applying roller 23, the power feeding roller 41 and the holding roller 38 are moved while keeping their relative positions. The current-applying roller 23 is moved to a given position in a rolling manner, in a state in which the current-applying roller 23 is electrically connected to the bus bar 25 via the power feeding roller 41 and in a state in which the current-applying roller 23 is contacting the workpiece W to apply an electric current to the workpiece W.

In this way, a current-applied portion of the heating target region of the workpiece W is spread from a narrow range to a wide range, and each portion of the heating target region in the moving direction is applied with an electric current for different current-applying time. That is, one end side of the workpiece W contacting the fixed electrode 12 is applied with an electric current for a longer time and the current-applying time becomes shorter toward the other end side thereof.

At this time, when the shape of the workpiece W has a substantially constant thickness, the side thereof in contact with the fixed electrode 12 has a wide width and the other side thereof has a narrow width, it is possible to heat the entire heating target region of the workpiece W in a substantially uniform manner by adjusting the moving speed and the moving amount of the current-applying roller 23 in accordance with the shape of the workpiece W.

Further, it is possible to heat the workpiece W while giving a temperature distribution by adjusting the moving speed and the moving amount of the current-applying roller 23 to be different from the shape change of the workpiece W, regardless of the shape of the workpiece W.

Advantageous Effect of First Embodiment

According to the current applying apparatus 20, the bus bar 25 is arranged along the workpiece W. Therefore, a loop is not formed by the bus bar 25 so that it is possible to reduce inductance component. As a result, the power factor is not degraded and therefore it is possible to apply a predetermined current to the workpiece W.

The moving electrode 11 is movable relative to the bus bar 25 and the workpiece W in an electrically contacting manner such that an electric current flows between the bus bar 25 and the workpiece W through the moving electrode 1. Therefore, it is possible to change the region of the workpiece W to which a large current is applied or to change a current-applying time.

The relative position between the workpiece W and the bus bar 25 is not changed and the constant of circuit configured by including the workpiece W as a load is not changed.

Further, the current-applying region or the current-applying time can be changed just by moving the moving electrode 11. Therefore, it is not necessary to provide a complex structure including a number of electrodes or power feeding structures or a structure for moving the workpiece W or the bus bar 25 is provided. Accordingly, it is possible to provide the current applying apparatus 20 in a simple and compact manner. As a result, it is possible to realize an easy and simple configuration in which a predetermined large current can be supplied to the current-applying region of the workpiece W by changing the current-applying region or the current-applying time.

In this apparatus, the moving electrode 11 is arranged between the bus bar 25 and the workpiece W. Therefore, it is possible to shorten the power feeding path from the bus bar 25 to the workpiece W and therefore it is possible to reduce the loss.

Further, since the moving electrode 11 is configured by the current-applying roller 23, it is possible to reduce mechanical resistance when moving the moving electrode 11 and therefore the moving electrode can be easily moved even in a state where the moving electrode is in contact with the workpiece W over a long range. Accordingly, it is possible to efficiently heat the heating target region of the workpiece W by increasing the contact length with the workpiece W.

Furthermore, when the moving electrode 11 is configured by the current-applying roller 23, the moving electrode can be stably moved in a state of being in contact with the surface of the workpiece W. That is, the moving electrode 11 can be prevented from being floated from the surface of the workpiece W due to vibration or the like, thereby preventing occurrence of spark. Further, it is possible to stably supply a large current to the workpiece W even when the moving electrode 11 is moved in a state in which the moving electrode 11 is supplied with an electric current.

In this apparatus, since the bus bar 25 facing the workpiece W faces the entire heating target region of the workpiece W excluding a portion thereof on which the fixed electrode 12 is placed, the moving electrode 11 and the bus bar 25 can be always connected in a proximity position when moving the moving electrode 11 and therefore it is possible to shorten the power feeding path. Furthermore, since the power feeding path from the bus bar 25 to the workpiece W is not changed when moving the moving electrode 11, it is possible to maintain a stable current-applying condition.

In this apparatus, since the workpiece W is pressed against the moving electrode 11 by the pressing member 36, the moving electrode 11 can be prevented from being floated from the surface of the workpiece W when moving the moving electrode 11 and therefore an electric current can stably be applied to the workpiece W.

Further, since the electric current is applied by contacting the moving electrode 11 to the workpiece W across the entire width of the heating target region of the workpiece W, the electric current is applied to the entire heating target region when the moving electrode is moved in one direction intersecting the widthwise direction of the workpiece W. Accordingly, it is possible to shorten the current-applying time by efficiently heating the workpiece with a simple configuration.

Particularly, since the apparatus of the first embodiment includes the power feeding roller 41 which rolls in contact with the bus bar 25, it is possible to reduce the moving resistance when moving the power feeding roller in contact with the surface of the bus bar 25 and therefore it is possible to easily move the power feeding roller in contact with the bus bar 25 over a long range thereof. Accordingly, a long contact length with the bus bar 25 can be secured and therefore a large current can be easily supplied from the bus bar 25.

Further, in the apparatus of the present embodiment, since the power feeding roller 41 is moved together with the current-applying roller 23, the power feeding path from the bus bar 25 to the moving electrode 11 can be kept substantially constant when moving the moving electrode 11. Accordingly, it is possible to reduce or eliminate variations in the electrical conditions when moving the moving electrode 11 and therefore it is possible to stably supply a large current to the workpiece W.

In the apparatus of the first embodiment, since the current-applying roller 23 and the power feeding roller 41 are in direct contact with each other while being rolled in opposite directions, the peripheral surface of the power feeding roller 41 and the peripheral surface of the current-applying roller 23 does not slide in the contact portion therebetween and therefore the power feeding roller 41 and the current-applying roller 23 can be moved in a state being in contact with each other over a wide range while reducing the contact resistance therebetween. For this reason, the wide contact width between the surface of the power feeding roller 41 and the surface of the current-applying roller 23 can be secured, so that a large current can be easily supplied to the current-applying roller 23 from the power feeding roller 41. Furthermore, since the power feeding path from the bus bar 25 to the workpiece W is provided by the surface of the power feeding roller 41 and the surface of the current-applying roller 23, the power feeding path can be significantly simplified and therefore it is possible to more easily supply a large current.

Modification of First Embodiment

Figure 4:
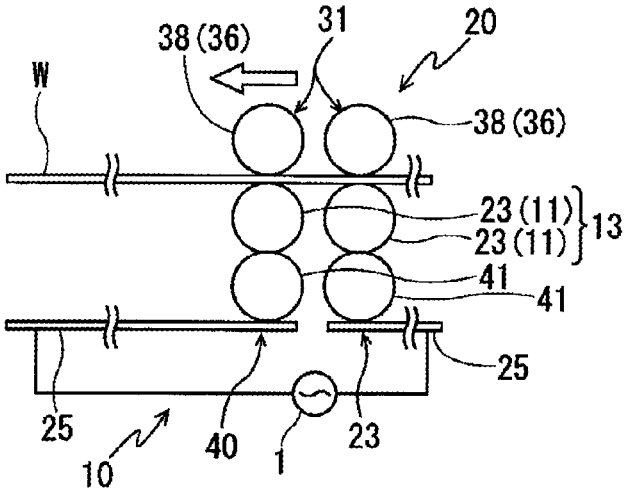
FIG. 4 is a side view schematically showing a structure of the current applying apparatus mounted on the heating apparatus in a modification of the first embodiment.

Although an example of using one electrode of the pair of electrodes 13 as the moving electrode 11 has been described in the first embodiment, both electrodes of the pair of electrodes 13 may be configured as the moving electrodes 11, 11, as shown in FIG. 4. In this case, the bus bars 25, 25 are separately provided so as to correspond to the moving range of both electrodes 11, 11 and respectively configure the current applying apparatus 20 as described above. Then, the heating target region is heated by moving both electrodes 11, 11 in a direction away from each other from the adjacent position in a state where voltage is applied between both bus bars 25, 25. Also in this current applying apparatus, the same operational effects as those described above can be obtained.

Another Modification of First Embodiment

Figure 5:
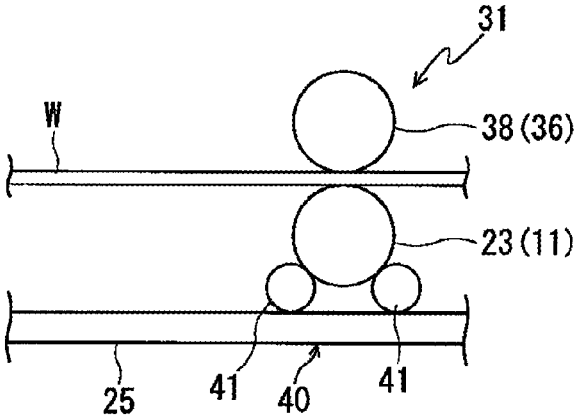
FIG. 5 is a side view schematically showing a structure of the current applying apparatus mounted on the heating apparatus in another modification of the first embodiment.

FIG. 5 shows another modification of the first embodiment.

In the first embodiment, the power feeding roller 41 is mounted on the movement frame 37 so as to be located at a predetermined position with respect to the current-applying roller 23 and an axis of the current-applying roller 23 and an axis of the power feeding roller 41 are arranged so as to be overlapped with the same position in the longitudinal direction of the workpiece W and the bus bar 25.

On the contrary, in this modification, each of the rollers 23, 41 is disposed so as to be shifted from each other in the moving direction of the moving unit 31. In addition to this, a plurality of power feeding roller 23 whose diameter is thinner than that of the current-applying roller 23 is provided back and forth.

When the power feeding roller 41 is disposed at a position shifted with respect to the current-applying rollers 23 in this way, the workpiece W and the bus bar 25 can be disposed at adjacent positions. As a result, it is possible to make inductance smaller and also it is possible to achieve compactness of the current applying apparatus 20.

Second Embodiment

Figure 6:
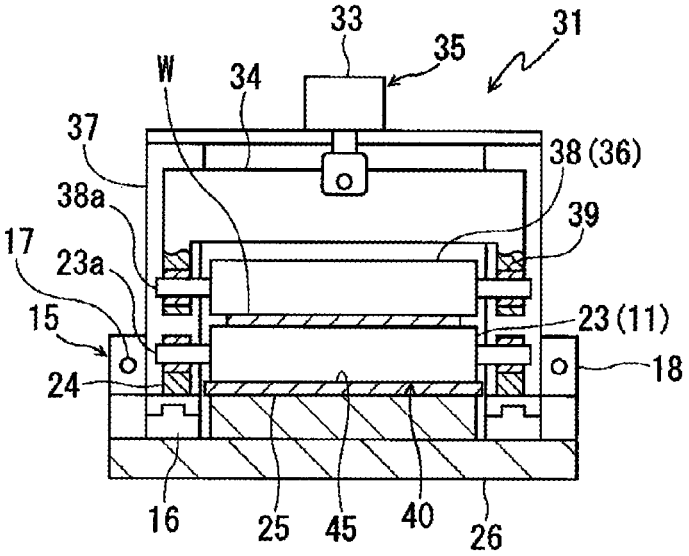
FIG. 6 is a sectional view showing a current applying apparatus mounted on a heating apparatus in a second embodiment.
Figure 7:
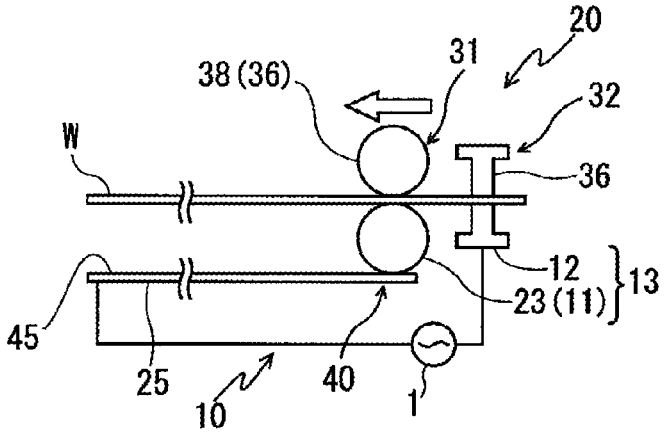
FIG. 7 is a side view schematically showing a structure of the current applying apparatus mounted on the heating apparatus in the second embodiment.

As shown in FIG. 6 and FIG. 7, the direct resistance heating apparatus 10 of the second embodiment includes the power supply unit 1 for feeding current to the workpiece W and the current applying apparatus 20 connected to the power supply unit 1. The current applying apparatus 20 includes the bus bar 25, the moving unit 31 having the moving electrode 11 and the fixed unit 32 having the fixed electrode 12. The current applying apparatus 20 is provided with a workpiece support portion which supports the workpiece W in a predetermined position (not shown). A surface of the bus bar 25 is arranged substantially parallel along a surface of the workpiece W when the workpiece W is supported on the workpiece support portion.

The power supply unit 1 can supply a predetermined alternating current to the workpiece W during direct resistance heating. The power supply unit may be provided integrally with the current applying apparatus or separately from the current applying apparatus.

The bus bar 25 is a rigid plate material which is made of high conductive material such as copper and has a cross-sectional area enough to feed current required for the direct resistance heating, for example. The bus bar 25 is fixed to the mounting base 26 so as to extend along the heating target region of the workpiece W and connected to one electrode of the power supply unit 1. In the present embodiment, a surface of the bus bar facing the workpiece W is formed to face the entire heating target region of the workpiece W excluding a portion thereof on which the fixed electrode 12 is placed.

The moving unit 31 includes the moving electrode 11 disposed so as to contact with the heating target region of the workpiece W, the power feeding mechanism 40 for feeding power to the moving electrode 11 from the bus bar 25, the pressing member 36 disposed opposite to the moving electrode 11, the press mechanism 35 for driving the pressing member 36, and the moving mechanism 15 for moving the movement frame 37 on which these parts are integrally supported along the workpiece W.

The moving electrode 11 is moved together with the pressing member 36 and the press mechanism 35 in a state being supported on the movement frame 37 by the moving mechanism 15 while being in contact with the power feeding mechanism 40 in a state where the moving electrode is disposed between the bus bar 25 and the workpiece W.

The moving electrode 11, the pressing member 36 and the press mechanism 35 used in the moving unit 31 of the second embodiment can be the same as those of the first embodiment.

Figure 8:
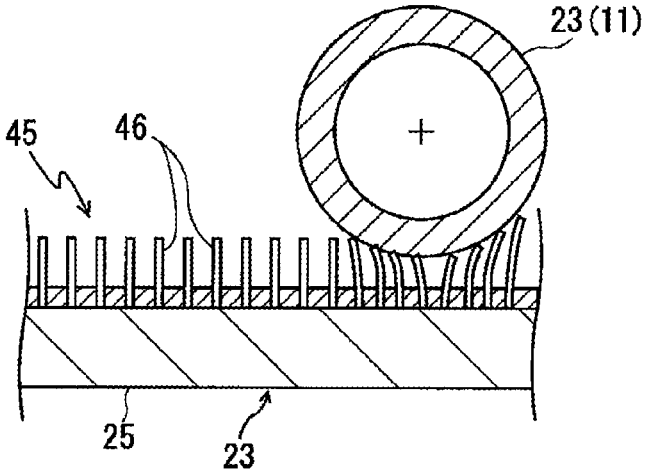
FIG. 8 is a partial sectional view schematically showing an electrically-conductive brush and a power feeding roller which are mounted on the heating apparatus in the second embodiment.

As shown in FIG. 8, the power feeding mechanism 40 of the second embodiment includes an electrically-conductive brush 45 which is integrally or separately provided on a surface of the bus bar 25 on the side of the workpiece W so as to allow the current-applying roller 23 to come into contact therewith and disposed on a substantially entire surface of the bus bar facing the workpiece W.

The electrically-conductive brush 45 includes a number of electrically-conductive fibers and is disposed on a substantially entire surface of the bus bar facing the heating target region of the workpiece W. The electrically-conductive brush 45 has a thickness to reach a height from the surface of the bus bar 25 so as to contact with the moving electrode 11. The electrically-conductive brush 45 is elastically deformed and brought into contact with the current-applying roller 23 with a suitable contact pressure when being brought into contact with the current-applying roller 23.

The electrically-conductive brush 45 is configured to be electrically-conductive to supply sufficient power from the bus bar 25 to the moving electrode 11 during direct resistance heating. For example, the electrically-conductive brush 45 and the bus bar 25 are in close contact with each other to give good conductivity therebetween, the electrically-conductive brush has sufficient conductivity up to the portion in contact with the moving electrode 11 on a leading end side thereof, the electrically-conductive brush has heat resistance to prevent occurrence of melting or thermal deformation when an electric current is applied, and deterioration hardly occurs even when the electrically-conductive brush is deformed due to the repetitive contact of the moving electrode.

The electrically-conductive brush 45 can be made in a suitable form, such as one obtained by arranging and bundling linear conductive fibers in the substantially same direction, one obtained by collecting conductive fibers into woven or non-woven fabric shape, one obtained by fixing conductive fibers by other material to allow a portion thereof to protrude, one obtained by molding conductive fibers together with flexible material, etc. Further, the electrically-conductive brush 45 may be formed integrally with the bus bar 25 by embedding a portion thereof into a material layer configuring the surface of the bus bar 25. As material configuring conductive fibers 46, carbon fiber or the like can be exemplified.

In the moving mechanism 15, the current-applying roller 23, the pressing member 36 and the press mechanism 35 are supported on the movement frame 37 in a state where the entire width of the current-applying roller 23 in contact with the workpiece W comes into contact with the electrically-conductive brush 45 and the movement frame 37 can be moved in a predetermined speed and a predetermined amount by the same structure as the first embodiment.

In this moving unit 31, as the current-applying roller 23 is moved by the movement frame 37, the current-applying roller 23 rolls and moves while being in contact with the surface of the workpiece W. At this time, since the current-applying roller 23 is moved while being in sliding contact with the electrically-conductive brush 45 disposed on the surface of the bus bar 25 and current from the bus bar 25 is supplied to the entire peripheral surface of the current-applying roller 23 via the electrically-conductive brush 45, the current-applying roller 23 can be moved in a state in which an electric current is being applied to the workpiece W.

The fixed unit 32 of the second embodiment includes the fixed electrode 12 disposed so as to contact with an end portion of the heating target region of the workpiece W, the pressing member 36 disposed opposite to the fixed electrode 12 and a press mechanism 35 for driving the pressing member 36. The fixed electrode 12 is connected to the other electrode of the power supply unit 1. The fixed electrode 12, the pressing member 36 and the press mechanism 35 are the same as those of the first embodiment.

Direct Resistance Heating Method

Next, a method for heating the workpiece W by supplying current to the workpiece W using the direct resistance heating apparatus 10 will be described.

First, a plate-like workpiece W is placed at a predetermined position in a substantially horizontal state by the workpiece support portion. Thereby, a surface of the bus bar 25 is disposed adjacent to and along the entire heating target region of the workpiece W, so that the surface of the bus bar 25 and one surface of the workpiece W are opposed to each other in a substantially parallel manner.

In the fixed unit 32, the end portion of the heating target region of the workpiece W is brought into contact with the surface of the fixed electrode 12 and the workpiece W is pressed against the fixed electrode 12 by the pressing member 36. Further, in the fixed unit 32, the end portion of the heating target region of the workpiece W is brought into contact, in the vicinity thereof, with the surface of the current-applying roller 23 and the workpiece W is pressed against the current-applying roller 23 by the holding roller 38.

In this state, voltage is applied to the fixed electrode 12 and the bus bar 25 from the power supply unit 1. Thereby, power is supplied from the bus bar 25 to the current-applying roller 23 through the electrically-conductive brush 45 and current is supplied to a heating target region between the current-applying roller 23 and the fixed electrode 12.

Thereafter, the movement frame 37 is moved in a direction away from the fixed unit 32 by the moving mechanism. Then, the current-applying roller 23 and the holding roller 38 are moved while keeping their relative positions. The current-applying roller 23 is moved to a given position in a rolling manner, in a state in which the current-applying roller 23 is electrically connected to the bus bar 25 via the electrically-conductive brush 45 and in a state in which the current-applying roller 23 is contacting the workpiece W to apply an electric current to the workpiece W.

In this way, a current-applied portion of the heating target region of the workpiece W is spread from a narrow range to a wide range, and each portion of the heating target region in the moving direction is applied with an electric current for different current-applying time. That is, one end side of the workpiece W contacting the fixed electrode 12 is applied with an electric current for a longer time and the current-applying time becomes shorter toward the other end side thereof, so that the heating target region of the workpiece W is heated.

At this time, the entire heating target region of the workpiece W can be heated in a substantially uniform manner or the workpiece W can be heated while giving a temperature distribution by adjusting the moving speed and the moving amount of the current-applying roller, as in the first embodiment.

Advantageous Effect of Second Embodiment

In this direct resistance heating apparatus 10, the same operational effects as the first embodiment are obtained as follows.

That is, similarly to the first embodiment, the bus bar 25 is arranged along the workpiece W. Therefore, a loop is not formed by the bus bar 25 so that it is possible to reduce inductance component. As a result, the power factor is not degraded and therefore it is possible to apply a predetermined current to the workpiece W.

The moving electrode 11 is movable relative to the bus bar 25 and the workpiece W in an electrically contacting manner such that an electric current flows between the bus bar 25 and the workpiece W through the moving electrode 11. Therefore, it is possible to change the region of the workpiece W to which a large current is applied or to change a current-applying time.

The relative position between the workpiece W and the bus bar 25 is not changed and the constant of circuit configured by including the workpiece W as a load is not changed. Accordingly, it is possible to supply a predetermined current by a simple configuration.

Further, the current-applying region or the current-applying time can be changed just by moving the moving electrode 11. Therefore, it is not necessary to provide a complex structure including a number of electrodes or power feeding structures or a structure for moving the workpiece W or the bus bar 25. Accordingly, it is possible to provide the current applying apparatus 20 in a simple and compact manner.

As a result, it is possible to realize an easy and simple configuration in which a predetermined large current can be supplied to the current-applying region of the workpiece W by changing the current-applying region or the current-applying time.

In this apparatus, since the moving electrode 11 is arranged between the bus bar 25 and the workpiece W, it is possible to shorten the power feeding path from the bus bar 25 to the workpiece W and therefore it is possible to reduce the loss.

Further, since the moving electrode 11 is configured by the current-applying roller 23, it is possible to reduce mechanical resistance when moving the moving electrode 11 and therefore the moving electrode can be easily moved even in a state where the moving electrode is in contact with the workpiece W over a long range. Accordingly, it is possible to efficiently heat the heating target region of the workpiece W by increasing the contact length with the workpiece W.

Furthermore, when the moving electrode 11 is configured by the current-applying roller 23, the moving electrode can be stably moved in a state of being in contact with the surface of the workpiece W. That is, the moving electrode 11 can be prevented from being floated from the surface of the workpiece W due to vibration or the like, thereby preventing occurrence of spark. Further, it is possible to stably supply a large current to the workpiece W even when the moving electrode 11 is moved in a state in which the moving electrode 11 is being supplied with an electric current.

In this apparatus, since the bus bar 25 facing the workpiece W faces the entire heating target region of the workpiece W excluding a portion thereof on which the fixed electrode 12 is placed, the moving electrode 11 and the bus bar 25 can be always connected in a proximity position when moving the moving electrode 11 and therefore it is possible to shorten the power feeding path. Furthermore, since the power feeding path from the bus bar 25 to the workpiece W is not changed when moving the moving electrode 11, it is possible to maintain a stable current-applying condition.

In this apparatus, since the workpiece W is pressed against the moving electrode 11 by the pressing member 36, the moving electrode 11 can be prevented from being floated from the surface of the workpiece W when moving the moving electrode 11 and therefore an electric current can stably be applied to the workpiece W.

Further, an electric current is applied by contacting the moving electrode 11 to the workpiece W across the entire width of the heating target region of the workpiece W. Therefore, the electric current is applied to the entire heating target region when the moving electrode is moved in one direction intersecting the widthwise direction of the workpiece W.

Further, since the second embodiment has a configuration different from the first embodiment, operational effects owing to the difference in the configuration are also obtained.

That is, in the second embodiment, since the moving electrode 11 is in sliding contact with the electrically-conductive brush 45 of the bus bar 25, it is possible to reduce the contact resistance of the moving electrode 11 and therefore it is possible to move the bus bar 25 and the moving electrode 11 in contact with each other over a long range. Accordingly, a long contact length between the moving electrode 11 and the bus bar 25 can be secured and therefore a large current can be easily supplied from the bus bar 25 to the moving electrode 11.

Furthermore, since the power feeding path from the bus bar 25 to the workpiece W is provided by the electrically-conductive brush 45 and the moving electrode 11, a configuration thereof can be significantly simplified.

Further, in the second embodiment, since the electrically-conductive brush 45 is arranged so as to face the substantially entire heating target region of the workpiece W, power can be supplied from the opposing portion of the electrically-conductive brush 45 to each portion of the heating target region. Accordingly, the power feeding path from the electrically-conductive brush 45 to the workpiece W can be substantially constant by shortening the length thereof and therefore the entire heating target region can be applied with an electric current in an uniform manner.

Modification of Second Embodiment

Figure 9:
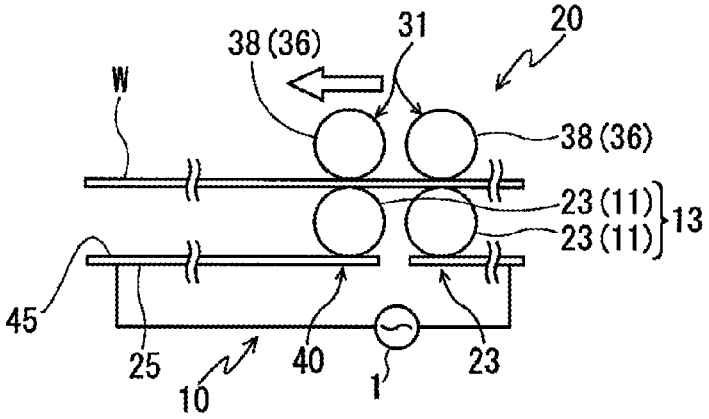
FIG. 9 is a side view schematically showing a structure of the current applying apparatus mounted on the heating apparatus in a modification of the second embodiment.

Although an example of using one electrode of the pair of electrodes 13 as the moving electrode 11 has been described in the second embodiment, both electrodes of the pair of electrodes 13 may be configured as the moving electrodes 11, 11, as shown in FIG. 9. In this case, the bus bars 25 and the electrically-conductive brushes 45 are separately provided so as to correspond to the moving range of both electrodes 11, 11 and respectively configure the current applying apparatus 20 as described above. Then, the heating target region is heated by moving both electrodes 11, 11 in a direction away from each other from the adjacent position in a state where voltage is applied between both bus bars 25. Also in this current applying apparatus 20, the same operational effects as those described above can be obtained.

Third Embodiment

Figure 10:
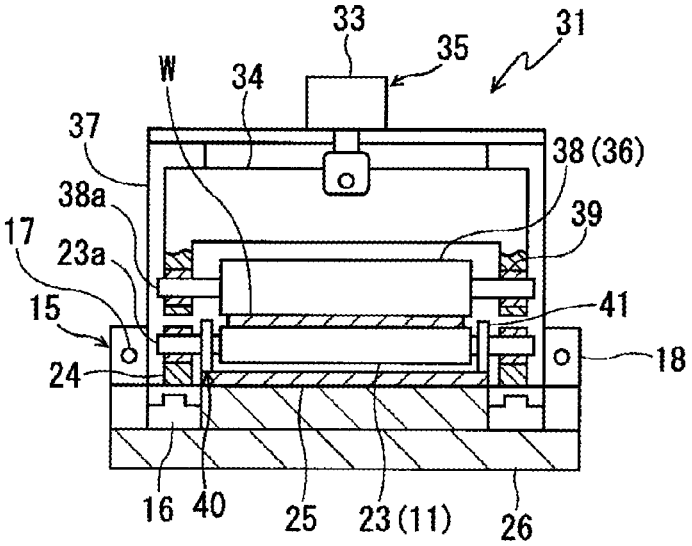
FIG. 10 is a sectional view showing a current applying apparatus mounted on a heating apparatus in a third embodiment.
Figure 11:
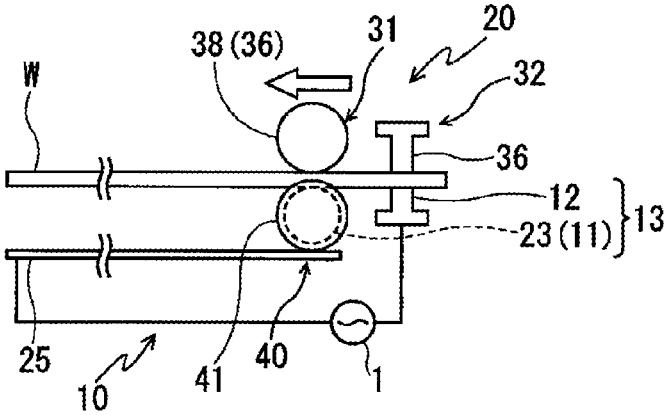
FIG. 11 is a side view schematically showing a structure of the current applying apparatus mounted on the heating apparatus in the third embodiment.

As shown in FIG. 10 and FIG. 11, the direct resistance heating apparatus 10 of the third embodiment includes the power supply unit 1 for feeding current to the workpiece W and the current applying apparatus 20 connected to the power supply unit 1. The current applying apparatus 20 includes the bus bar 25, the moving unit 31 having the moving electrode 11 and the fixed unit 32 having the fixed electrode 12. The current applying apparatus 20 is provided with a workpiece support portion which supports the workpiece W in a predetermined position (not shown). A surface of the bus bar 25 is arranged substantially parallel along a surface of the workpiece W when the workpiece W is supported on the workpiece support portion.

The power supply unit 1 can supply a predetermined alternating current to the workpiece W during direct resistance heating. The power supply unit may be provided integrally with the current applying apparatus or separately from the current applying apparatus.

Similarly to the first embodiment, the bus bar 25 is a rigid plate material which is made of high conductive material such as copper and has a cross-sectional area enough to feed current required for the direct resistance heating, for example. The bus bar 25 is fixed to the mounting base 26 so as to extend along the heating target region of the workpiece W and connected to one electrode of the power supply unit 1.

In the present embodiment, the surface of the bus bar facing the workpiece W has a size opposed to the entire heating target region of the workpiece W excluding a portion thereof on which the fixed electrode 12 is placed and a width opposed to the current-applying roller 23 and the power feeding roller 41 of the moving unit 31. The surface of the bus bar facing the workpiece is entirely formed in a smooth plane. The surface of the bus bar facing the workpiece W is formed in a smooth plane which faces the entire heating target region of the workpiece W excluding a portion thereof on which the fixed electrode 12 is placed.

The moving unit 31 of the third embodiment includes the moving electrode 11 disposed so as to contact with the heating target region of the workpiece W, a power feeding mechanism 40 for feeding power to the moving electrode 11 from the bus bar 25, a pressing member 36 disposed opposite to the moving electrode 11, a press mechanism 35 for driving the pressing member 36, and the moving mechanism 15 for moving a movement frame 37 on which these parts are supported along the workpiece W.

The pressing member 36 and the press mechanism 35 used in the moving unit 31 of the third embodiment can be the same as those of the first embodiment.

The moving electrode 11 is configured by the current-applying roller 23 which rolls in contact with a surface of the workpiece W. Entire peripheral surface and the shaft portion 23*a* of the current-applying roller 23 are made of an electrically-conductive material and a portion between the entire peripheral surface and the shaft portion 23*a* has sufficient conductivity. The current-applying roller 23 is rotatably supported on the bearing portion 24 which is mounted to the movement frame 37. The peripheral surface of the current-applying roller 23 comes into contact with the heating target region of the workpiece W in a direction perpendicular to a moving direction and the contact portion extends across the entire width of the heating target region. Similarly to the first embodiment, the current-applying roller 23 is formed of high conductive material such as copper, cast iron and carbon and configured as a smooth surface having a circular section.

The power feeding mechanism 40 includes power feeding rollers 41 configured to contact and roll on the surface of the bus bar 25. Each of the power feeding rollers 41 has a diameter larger than a diameter of the current-applying roller 23. The power feeding rollers 41 are mounted on the shaft portion 23*a* at respective ends of the current-applying roller 23. The power feeding roller 41 may be fixed to the shaft portion 23*a*, or may be pivotably mounted to the shaft portion 23*a* via a slide bearing made of metal or the like softer than the shaft portion 23*a*. It is desirable that a portion between the peripheral surface of the power feeding roller 41 and the shaft portion 23*a* has sufficient conductivity.

The moving mechanism 15 is configured similarly to the first embodiment. In the present embodiment, the bearing portion 24 of the shaft portion 23*a* for supporting the current-applying roller 23 and the power feeding roller 41 and the bearing portion 39 of the holding roller 38 can be moved by being supported on the movement frame 37.

In the moving mechanism 15, when the threaded shaft 17 is driven while the rotation speed or the rotation amount thereof is controlled, the movement frame is moved in a predetermined speed and a predetermined amount along the slide rail 16 and correspondingly, the current-applying roller 23 and the power feeding roller 41 are moved. At this time, the power feeding roller 41 can be moved in contact with the bus bar 25, in a state where the current-applying roller 23 is in contact with the workpiece W.

As the pressing member 36 is pressurized, the workpiece W is pressed against the current-applying roller 23. Since the power feeding roller 41 has a diameter larger than that of the current-applying roller 23, the current-applying roller 23 is pressed against the workpiece W in a state of being spaced apart from the surface of the bus bar 25. Further, since the power feeding roller 41 is disposed on the outside of both sides of the workpiece W, the power feeding roller is pressed against both edges of the bus bar 25 without contacting the workpiece W.

Meanwhile, the fixed unit 32 of the third embodiment includes the fixed electrode 12 disposed so as to contact with an end portion of the heating target region of the workpiece W, the pressing member 36 disposed opposite to the fixed electrode 12 and a press mechanism 35 for driving the pressing member 36. The fixed electrode 12 is connected to the other electrode of the power supply unit 1. The fixed electrode 12, the pressing member 36 and the press mechanism 35 are the same as those of the first embodiment.

Direct Resistance Heating Method

Next, a method for heating the workpiece W by supplying current to the workpiece W using the direct resistance heating apparatus 10 will be described.

First, a plate-like workpiece W is placed at a predetermined position in a substantially horizontal state by the workpiece support portion. Thereby, a surface of the bus bar 25 is disposed adjacent to and along the entire heating target region of the workpiece W, so that the surface of the bus bar 25 and one surface of the workpiece W are opposed to each other in a substantially parallel manner.

In the fixed unit 32, the end portion of the heating target region of the workpiece W is brought into contact with the surface of the fixed electrode 12 and the workpiece W is pressed against the fixed electrode 12 by the pressing member 36. Further, in the fixed unit 32, the end portion of the heating target region of the workpiece W is brought into contact, in the vicinity thereof, with the surface of the current-applying roller 23 and the workpiece W is pressed against the current-applying roller 23 by the holding roller 38.

In this state, voltage is applied to the fixed electrode 12 and the bus bar 25 from the power supply unit 1. Thereby, power is supplied from the bus bar 25 to the current-applying roller 23 through the power feeding roller 41 and current is supplied to a heating target region between the current-applying roller 23 and the fixed electrode 12.

Thereafter, the movement frame 37 is moved in a direction away from the fixed unit 32 by the moving mechanism. Then, the current-applying roller 23 and the holding roller 38 are moved while keeping their relative positions. The current-applying roller 23 is moved to a given position in a rolling manner, in a state in which the current-applying roller 23 is electrically connected to the bus bar 25 via the power feeding roller 41 and in a state in which the current-applying roller 23 is contacting the workpiece W to apply an electric current to the workpiece W. The current-applying roller 23 and the power feeding roller 41 may be rotated in opposite directions. One of the current-applying roller 23 and the power feeding roller 41 may slide on the workpiece W or the bus bar 25.

In this way, a current-applied portion of the heating target region of the workpiece W is spread from a narrow range to a wide range, and each portion of the heating target region in the moving direction is applied with an electric current for different current-applying time. That is, one end side of the workpiece W contacting the fixed electrode 12 is applied with an electric current for a longer time and the current-applying time becomes shorter toward the other end side thereof, so that the heating target region of the workpiece W is heated.

The entire heating target region of the workpiece W can be heated in a substantially uniform manner and the workpiece W can be heated while giving a temperature distribution by adjusting the moving speed and the moving amount of the current-applying roller, as in the first embodiment.

Advantageous Effect of Third Embodiment

In the direct resistance heating apparatus 10 as described above, the same operational effects as the first embodiment are obtained as follows.

That is, similarly to the first embodiment, the bus bar 25 is arranged along the workpiece W. Therefore, a loop is not formed by the bus bar 25 so that it is possible to reduce inductance component. As a result, the power factor is not degraded and therefore it is possible to apply a predetermined current to the workpiece W.

The moving electrode 11 is movable relative to the bus bar 25 and the workpiece W in an electrically contacting manner such that an electric current flows between the bus bar 25 and the workpiece W through the moving electrode 11. Therefore, it is possible to change the region of the workpiece W to which a large current is applied or to change the current-applying time.

The relative position between the workpiece W and the bus bar 25 is not changed and the constant of circuit configured by including the workpiece W as a load is not changed. Accordingly, it is possible to supply a predetermined current by a simple configuration.

Further, the current-applying region or the current-applying time can be changed just by moving the moving electrode 11. Therefore, it is not necessary to provide a complex structure including a number of electrodes or power feeding structures or a structure for moving the workpiece W or the bus bar 25. Accordingly, it is possible to form the current applying apparatus 20 in a simple and compact manner.

In this apparatus, since the moving electrode 11 is arranged between the bus bar 25 and the workpiece W, it is possible to shorten the power feeding path from the bus bar 25 to the workpiece W and therefore it is possible to reduce the loss.

Further, since the moving electrode 11 is configured by the current-applying roller 23, it is possible to reduce mechanical resistance when moving the moving electrode 11 and therefore the moving electrode can be easily moved even in a state where the moving electrode is in contact with the workpiece W over a long range. Accordingly, it is possible to efficiently heat the heating target region of the workpiece W by increasing the contact length with the workpiece W.

Furthermore, when the moving electrode 11 is configured by the current-applying roller 23, the moving electrode can be stably moved in a state of being in contact with the surface of the workpiece W. For example, the moving electrode 11 can be prevented from being floated from the surface of the workpiece W due to vibration or the like, thereby preventing occurrence of spark. Further, it is possible to stably supply a large current to the workpiece W even when the moving electrode 11 is moved in a state in which the moving electrode 11 is being supplied with an electric current.

In this apparatus, since the bus bar 25 facing the workpiece W faces the entire heating target region of the workpiece W excluding a portion thereof on which the fixed electrode 12 is placed, the moving electrode 11 and the bus bar 25 can be always connected in a proximity position when moving the moving electrode 11 and therefore it is possible to shorten the power feeding path. Furthermore, since the power feeding path from the bus bar 25 to the workpiece W is not changed when moving the moving electrode 11, it is possible to maintain a stable current-applying condition.

In this apparatus, since the workpiece W is pressed against the moving electrode 11 by the pressing member 36, the moving electrode 11 can be prevented from being floated from the surface of the workpiece W when moving the moving electrode 11 and therefore an electric current can stably be applied to the workpiece W.

Further, an electric current is applied by contacting the moving electrode 11 to the workpiece W across the entire width the heating target region of the workpiece W. Therefore, the electric current is applied to the entire heating target region when the moving electrode is moved in one direction intersecting the widthwise direction of the workpiece W.

Further, since the third embodiment has a configuration different from the first embodiment, operational effects owing to the difference in the configuration are also obtained.

That is, in the apparatus of the third embodiment, since the power feeding rollers 41 are provided on both ends of the moving electrode 11 and moved in contact with the bus bar 25, it is possible to reduce a gap between the bus bar 25 and the workpiece W. Further, it is possible to reduce the moving resistance to the bus bar 25 or the moving resistance to the workpiece W, regardless of the size of the moving electrode 11. Accordingly, a large current can be more easily supplied.

Modification of Third Embodiment

Figure 12:
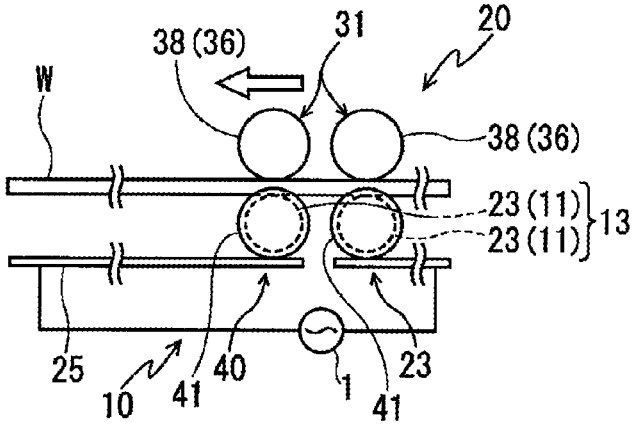
FIG. 12 is a side view schematically showing a structure of the current applying apparatus mounted on the heating apparatus in a modification of the third embodiment.

Although one electrode of the pair of electrodes 13 has been used as the moving electrode 11 in the third embodiment, both electrodes of the pair of electrodes 13 may be configured as the moving electrodes 11, 11, as shown in FIG. 12. In this case, the bus bars 25, 25 are separately provided so as to correspond to the moving range of both electrodes 11, 11 and respectively configure the current applying apparatus 20 as described above. Then, the heating target region is heated by moving both electrodes 11, 11 in a direction away from each other from the adjacent position in a state where voltage is applied between both bus bars 25, 25. Also in this current applying apparatus 20, the same operational effects as those described above can be obtained.

Further, although the current-applying roller 23 and the power feeding roller 41 are mounted on the same shaft in the third embodiment, the current-applying roller 23 and the power feeding roller 41 may be mounted on the different shafts such that the current-applying roller 23 and the power feeding roller 41 are electrically connected.

Each of the embodiments described above can be changed as appropriate within the scope of the present invention. For example, although an example of using the current applying apparatus as the direct resistance heating apparatus has been described in each of the embodiments described above, the current applying apparatus of the present invention may be an apparatus other than the direct resistance heating apparatus for the workpiece. Even in this case, the current applying apparatus of the present invention can be used to supply current to the workpiece.

Although an example of changing a gap between a pair of moving electrodes 11 by moving a pair of moving electrodes 11 while applying an electric current has been described in each of the embodiments described above, the electric current may be applied by moving a pair of moving electrodes 11 with respect to the workpiece W and the bus bar 25 while making the relative positions thereof constant and thus keeping the same interval therebetween.

Although an example of using the current-applying roller 23 rolling in contact with the surface of the workpiece W as the moving electrode has been described in each of the embodiments described above, a member sliding on the surface of the workpiece W may be used as the moving electrode, for example.

INDUSTRIAL APPLICABILITY

One or more embodiments of the invention provide a current applying apparatus, a current applying method and a direct resistance heating apparatus having the current applying apparatus, which can easily apply, with a simple configuration, a large current to a current-applying region of a workpiece and can change the current-applying region or a current-applying time.

This application is based on Japanese Patent Application No. 2012-126593 filed on Jun. 1, 2012, the entire content of which is incorporated herein by reference.

The invention claimed is:

1. A current applying apparatus comprising:

a pair of electrodes configured to contact a workpiece to apply an electric current to the workpiece; and a bus bar having a surface arranged to extend along the workpiece, wherein at least one of the electrodes comprises a moving electrode configured to move relative to the bus bar and the workpiece such that an electric current flows between the bus bar and the workpiece through the moving electrode, the moving electrode being connected to the bus bar so as to be movable relative to the bus bar, and the moving electrode being configured to contact the workpiece so as to be movable relative to the workpiece, wherein the current applying apparatus further comprises a power feeding roller configured to contact and roll on the surface of the bus bar and to move together with the moving electrode, and wherein the power feeding roller comprises an electrically-conductive peripheral surface from which the electric current is supplied to the moving electrode.

2. The current applying apparatus according to claim 1, wherein the moving electrode is arranged between the bus bar and the workpiece.

3. The current applying apparatus according to claim 1, wherein the moving electrode comprises a current-applying roller configured to roll on a surface of the workpiece, and the current-applying roller comprising an electrically-conductive peripheral surface from which the electric current is applied to the surface of the workpiece.

4. The current applying apparatus according to claim 3, wherein the current-applying roller and the power feeding roller are arranged to rotate in opposite directions and to contact each other.

5. The current applying apparatus according to claim 4, wherein an axis of the power feeding roller is arranged at a position shifted from a plane including a portion of the current-applying roller contacting the workpiece and an axis of the current-applying roller.

6. The current applying apparatus according to claim 1, wherein the power feeding roller is provided on both axial end portions of the moving electrode to supply the electric current from the power feeding roller to the moving electrode.

7. The current applying apparatus according to claim 1, further comprising a pressing member arranged to face the moving electrode and to move together with the moving electrode, wherein the pressing member is configured to press the workpiece against the moving electrode.

8. The current applying apparatus according to claim 1, wherein the surface of the bus bar is arranged to face the workpiece.

9. The current applying apparatus according to claim 1, wherein, in a direction perpendicular to a direction in which the moving electrode moves, the bus bar extends along the entire length of a portion of the moving electrode that is configured to contact the workpiece.

10. A current applying method for applying an electric current to a workpiece by contacting a pair of electrodes to the workpiece, the current applying method comprising:

providing a bus bar to extend along the workpiece and to face the workpiece;

moving at least one of the electrodes relative to the bus bar and the workpiece such that an electric current flows between the bus bar and the workpiece through the at least one of the electrodes, with the at least one of the electrodes being connected to the bus bar and contacting the workpiece; and providing a power feeding roller to contact and roll on the surface of the bus bar and to move together with the at least one of the electrodes, wherein the electric current is supplied to the at least one of the electrodes from an electrically-conductive peripheral surface of the power feeding roller.

11. The current applying method according to claim 10, wherein the bus bar is provided such that a surface of the bus bar faces the workpiece.

12. The current applying method according to claim 10, wherein the bus bar is provided such that, in a direction perpendicular to a direction in which the moving electrode is moved, the bus bar extends along the entire length of a portion of the moving electrode that is configured to contact the workpiece.

13. A direct resistance heating apparatus comprising:

a current applying apparatus; and a power supply configured to supply electric current to the current applying apparatus, wherein the current applying apparatus comprises a pair of electrodes configured to contact a workpiece to apply the electric current to the workpiece, and a bus bar having a surface arranged to extend along the workpiece, wherein at least one of the electrodes comprises a moving electrode configured to move relative to the bus bar and the workpiece such that an electric current flows between the bus bar and the workpiece through the moving electrode, the moving electrode being connected to the bus bar so as to be movable relative to the bus bar, and the moving electrode being configured to contact the workpiece so as to be movable relative to the workpiece, wherein the current applying apparatus further comprises a power feeding roller configured to contact and roll on the surface of the bus bar and to move together with the moving electrode, and wherein the power feeding roller comprises an electrically-conductive peripheral surface from which the electric current is supplied to the moving electrode.

* * * * *